US007789698B2

(12) United States Patent
Hashimoto et al.

(10) Patent No.: US 7,789,698 B2
(45) Date of Patent: Sep. 7, 2010

(54) CONNECTOR FOR FLAT TERMINAL

(75) Inventors: Shunsuke Hashimoto, Tsu (JP); Yoshiharu Nishiyama, Hirakata (JP); Takuya Hayashi, Tsu (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/272,664

(22) Filed: Nov. 17, 2008

(65) Prior Publication Data

US 2009/0137141 A1 May 28, 2009

(30) Foreign Application Priority Data

Nov. 27, 2007 (JP) ..... 2007-306589

(51) Int. Cl.
*H01R 12/24* (2006.01)

(52) U.S. Cl. ..... 439/495; 439/260; 439/329

(58) Field of Classification Search ..... 439/492, 439/495, 260, 326
See application file for complete search history.

(56) References Cited

U.S. PATENT DOCUMENTS

| | | | | |
|---|---|---|---|---|
| 6,431,897 | B1 | 8/2002 | Hashiguchi et al. | |
| 7,029,319 | B2 * | 4/2006 | Kunishi | 439/492 |
| 7,189,104 | B1 | 3/2007 | Gillespie et al. | |
| 7,238,050 | B2 * | 7/2007 | Sakakura et al. | 439/607.52 |
| 7,255,594 | B2 * | 8/2007 | Huang et al. | 439/495 |
| 7,399,193 | B1 * | 7/2008 | Ho et al. | 439/260 |
| 7,455,547 | B2 * | 11/2008 | Hemmi et al. | 439/495 |
| 7,553,183 | B2 * | 6/2009 | Taketomi et al. | 439/495 |
| 2003/0157829 | A1 | 8/2003 | Kunishi et al. | |
| 2008/0207035 | A1 | 8/2008 | Jahn | |
| 2008/0242131 | A1 | 10/2008 | Tanaka et al. | |

FOREIGN PATENT DOCUMENTS

| | | | |
|---|---|---|---|
| CN | 201112672 | Y | 9/2008 |
| DE | 100 49 361 | A1 | 5/2001 |
| DE | 103 21 184 | A1 | 12/2004 |
| EP | 1 337 006 | A2 | 8/2003 |
| EP | 1 337 006 | A3 | 5/2005 |
| JP | 2001-110483 | A | 4/2001 |
| JP | 2008-243554 | A | 10/2008 |

OTHER PUBLICATIONS

European Search Report for the Application No. EP 08 01 9647 dated Apr. 3, 2009.
The First Office Action for the Application No. 200810178681.5 from The State Intellectual Property Office of the People's Republic of China dated Apr. 19, 2010.

* cited by examiner

*Primary Examiner*—Truc T Nguyen
(74) *Attorney, Agent, or Firm*—Cheng Law Group, PLLC

(57) ABSTRACT

A connector for a flat terminal includes a lever, a housing and contact. The lever has pivots. The housing is formed with a terminal recess and provided with bearings. The contact has a contact point and is located in the terminal recess. The housing includes guide ribs for separating the base end of the lever from the contact point in the process of attaching the lever to the housing. The contact point is located between the guide ribs. The guide ribs are formed on the bottom of the terminal recess in the housing, and stick out more than the contact point from the bottom of the terminal recess.

5 Claims, 8 Drawing Sheets

CONNECTOR FOR FLAT TERMINAL

BACKGROUND OF THE INVENTION

1. Field of the Invention

The invention relates generally to connectors and, more particularly, to a connector for a flat terminal (hereinafter also referred to as an "FPC connector") which can be connected with a flexible printed circuit (hereinafter also referred to as an "FPC").

2. Description of the Related Art

Japanese Patent Application Publication No. 2001-110483, published on Apr. 20, 2001 discloses a connector for a cable. The connector includes: first and second contacts having first and second contact points, respectively; a housing retaining the first and second contacts; and a lever (actuator) for connecting the first and second contact points with exposed conductive patterns in a flat terminal of an FPC inserted into the housing, respectively. The exposed conductive patterns are arranged at even intervals. The first and second contacts are alternately arranged at specified intervals in the length (width) direction of the housing.

The lever has pivots which stick out from both sides of the lever, respectively and first and second cams alternately arranged between the pivots. Each of the first contacts has upper and lower spring sections, and each upper spring section has a first pivotally supporting part. Each of the second contacts also has upper and lower spring sections, and each upper spring section of the second contacts has a second pivotally supporting part. The pivots are put in holes (bearings) located at both sides of the housing. The first pivotally supporting parts engage with the first cams of the lever, respectively. When the lever is opened, the second pivotally supporting parts are latched with the second cams of the lever, respectively. When the lever is closed, the second pivotally supporting parts are contact with the second cams, respectively. Thereby, the lever is pivotally supported.

The applicant (or assignee) of the present invention has filed a relevant technology having an expanded rotation range of a lever, namely Japanese Patent Application No. 2007-081569 entitled "Connector for a cable" on Mar. 27, 2007. As shown in FIGS. 1 and 2, the connector is an FPC connector which can be connected with an FPC, and includes first contacts 2, second contacts 3, a lever 4, inner side panels 5 and 5, and a housing 6. The housing 6 is made of synthetic resins and has a terminal recess 60 that has a top opening which can be opened and closed with the lever 4, and a slit opening.

The first and second contacts are alternately arranged between both sides of the terminal recess 60 in the housing 6. Each first contact 2 includes an upper beam having a first pivotally-supporting part 210 for pivotally supporting the lever 4, and a lower beam 22 having a first contact point 220. Each second contact 3 includes an upper beam having a second pivotally-supporting part 310 for pivotally supporting the lever 4, and a lower beam having a second contact point. The first and second contact points can be connected with exposed conductive patterns in a flat terminal of an FPC, respectively. The first and second pivotally-supporting parts are arranged approximately in line in the length direction of the housing 6. In each first contact 2, the first contact point 220 is located rearward by specified distance from the first pivotally-supporting part 210 in the insertion direction of the flat terminal into the terminal recess 60. In each second contact 3, the second contact point is located forward by specified distance from the second pivotally-supporting part 310 in the insertion direction.

The lever 4 includes pivots 41 and 41 which stick out from both sides of the lever 4, respectively, first cams, and pressers 43. Bearings (bearing planes) 512 and 512 are respectively located at both sides of the terminal recess 60 in the housing 6 and support the pivots 41 and 41. Insertion hole (through holes) 420 into which the second pivotally-supporting part 310 are inserted, respectively are formed in the lever 4, and thereby the first cams are provided. Therefore, each first cam is located between the base end of the lever 4 and its own insertion hole 420. Each presser 43 has an insertion hole (through holes) 430 into which the first pivotally-supporting part 210 of a first contact 2 is inserted, and a second cam 431. Each second cam 431 is located between the base end of the lever 4 and its own insertion hole 430. Each presser 43 is also formed so that it is thicker than the other parts of the lever 4. The second pivotally-supporting parts 310 engage with the first cams, respectively, and thereby the housing 6 pivotally supports the lever 4. That is, the terminal recess 60 can be opened and closed with the lever 4, and when the terminal recess 60 is closed with the lever 4, the flat terminal in the terminal recess 60 is pressed with each presser 43. Also, when the lever is opened, the first pivotally-supporting parts 210 are inserted into the insertion holes 430, and accordingly the rotation range of the lever 4 can be expanded in comparison with the connector of Japanese Patent Application Publication No. 2001-110483.

As shown in FIG. 2, the lever 4 is moved down and then attached to the housing 6 together with the inner side panels 5 and 5. In this process, each presser 43 is thicker than the other parts of the lever 4, and accordingly the base end of the lever 4 made of synthetic resins, namely the second cams 431 come into contact with the first contact points 220, respectively, and may be shaved. Because of this, if resin powder is stuck to a first contact point 220, contact failure can occur between a first contact point 220 and an exposed conductive pattern of an FPC.

SUMMARY OF THE INVENTION

It is an object of the present invention to separate the base end of a lever from a contact point in the process of attaching the lever to a housing and to cause the base end not to be contact with the contact point.

The present invention is a connector for a flat terminal comprising an exposed conductive pattern. The connector comprises a lever, a housing and a contact. The lever has pivots which stick out from both sides of the lever, respectively. The housing is formed with a terminal recess having a shape corresponding to the flat terminal. The housing is also provided with bearings which are located at both sides of the terminal recess and support the pivots so that the lever can open and close the terminal recess, respectively. The contact is located in the terminal recess and has a contact point connected with the exposed conductive pattern when the flat terminal is inserted into the terminal recess closed with the lever. The housing comprises guide ribs for separating the base end of the lever from the contact point in the process of attaching the lever to the housing. The contact point is located between the guide ribs. The guide ribs are formed on the bottom of the terminal recess in the housing and stick out more than the contact point from the bottom of the terminal recess.

In the present invention, the base end of the lever comes into contact with guide ribs sticking out more than the contact point before it comes into contact with the contact point in the process of attaching the lever to the housing. Accordingly, in the process of attaching the lever to the housing, the base end of the lever can be separated from the contact point. That is, even if the lever is made of synthetic resins, it is possible to prevent the lever from being shaved with the contact point. Consequently, contact failure between an exposed conductive pattern of a flat terminal and a contact can be prevented, and connection reliability of the connector can be improved.

In an embodiment, the terminal recess has a top opening and a slit opening constituting one opening. The top opening can be opened and closed with the lever. The slit opening is formed at the front side of the housing, and has a shape corresponding to the end face of the flat terminal. Each of the guide ribs has a slope which is higher at its own rear end than its own front end. The housing has inner walls combined with the rear ends of the guide ribs, respectively, and is also provided with inner side panels made of metal. The inner side panels are respectively located at both sides of the terminal recess. Each top end face of the inner side panels includes a temporary bearing plane, a guide slope and a bearing plane. The temporary bearing plane temporarily supports a corresponding pivot of said pivots in the process of attaching the lever to the housing. The guide slope guides the corresponding pivot toward a corresponding bearing of said bearings by the contact of the base end of the lever with the guide ribs and the inner walls in the process of attaching the lever to the housing. The bearing plane supports the corresponding pivot when the lever is attached to the housing. Said guide slope is higher at the front end of the guide slope than the rear end of the guide slope. The rear end of the guide slope is combined with said temporary bearing plane. Said bearing plane is said corresponding bearing and combined with the front end of said guide slope. The height of said bearing plane is higher than that of said temporary bearing plane.

In an embodiment, the lever integrally comprises a base and a handle. The base includes the pivots, and at least one first cam and at least one presser which are arranged between the pivots.

In an embodiment, the contact comprises at least one first contact having an upper beam and a lower beam. The lower beam has a first contact point which is said contact point, and a stopper fixed to the front edge of the terminal recess in the housing. The presser has an insertion hole into which the tip of the upper beam can be inserted, and a second cam formed at the upper rear of the insertion hole. The second cam is located between the upper and lower beams of the first contact. The second cam is in contact with the tip of the upper beam so that the pressing surface of the presser is sunk between the inner side panels when the terminal recess is closed with the lever.

In an embodiment, the connector comprises at least one second contact which is located in the terminal recess and has an upper beam and a lower beam. The flat terminal comprises exposed conductive patterns. The upper beam of the second contact has a pivotally-supporting part engaged with the first cam between the upper and lower beams of the second contact. The lower beam of the second contact has a second contact point which is located ahead of the first contact point and can be elastically connected with an exposed conductive pattern of the flat terminal.

BRIEF DESCRIPTION OF THE DRAWINGS

Preferred embodiments of the invention will now be described in further details. Other features and advantages of the present invention will become better understood with regard to the following detailed description and accompanying drawings where.

DETAILED DESCRIPTION OF EXEMPLARY EMBODIMENTS

Figure 1:
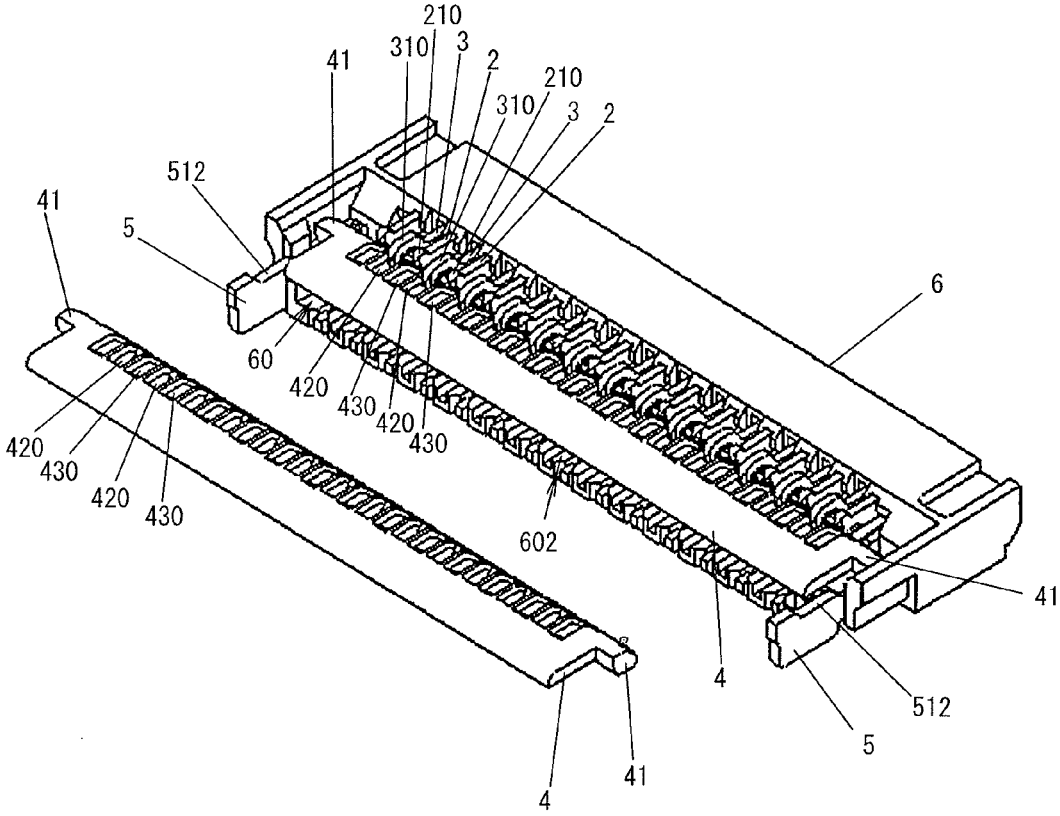
FIG. 1 is a perspective view of a connector for a cable, of a relevant technology to the present invention.
Figure 2:
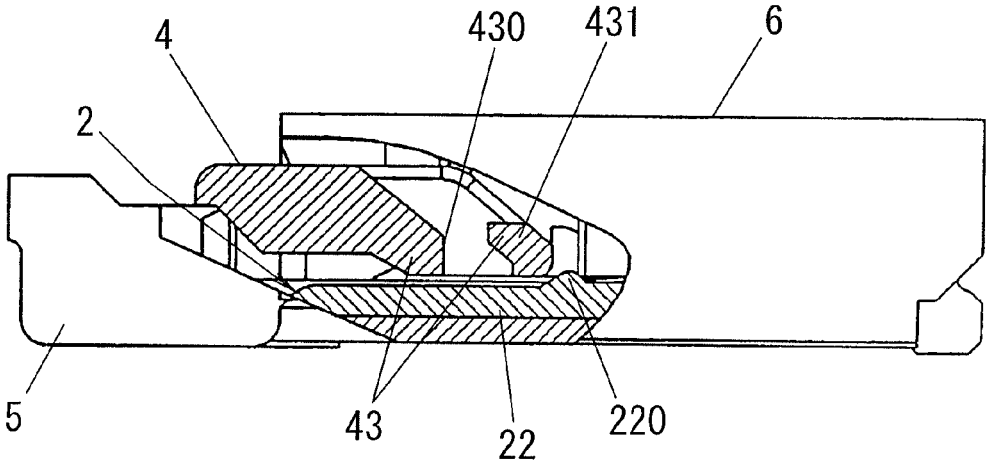
FIG. 2 is a partial exploded view of the connector of FIG. 1.
Figure 3:
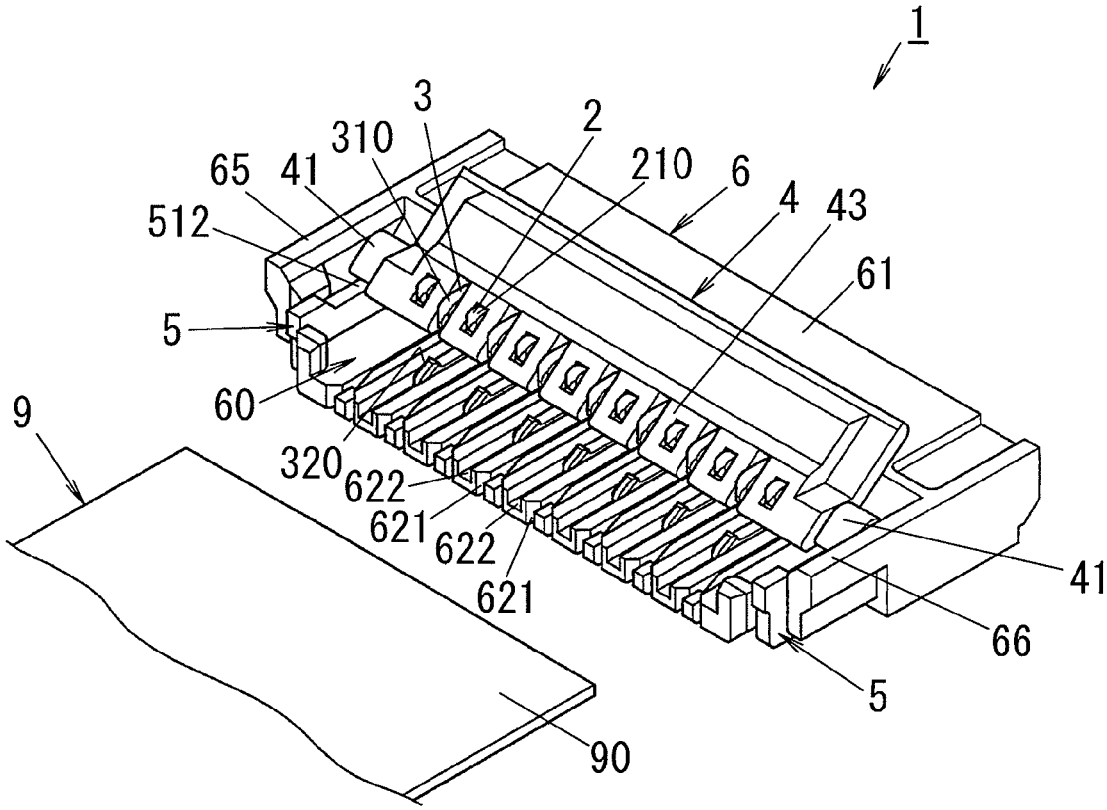
FIG. 3 is a perspective view of a connector for a flat terminal, in accordance with an embodiment of the present invention.

FIG. 3 shows a connector for a flat terminal, in accordance with an embodiment of the present invention. The connector 1 is, for example, an FPC connector which is connected with an FPC (9), and includes at least one first contact 2, at least one second contact 3, a lever 4 made of synthetic resins, inner side panels 5 and 5, and a housing 6 which is made of synthetic resins and has a terminal recess 60. The terminal recess 60 has a shape corresponding to a flat terminal 90 of the FPC (9). However, not limited to this, the flat terminal of the present invention may be one end of a flat ribbon cable or the like.

In the example of FIG. 3, the connector 1 is equipped with eight first contacts 2 and seven second contacts 3. The first and second contacts are made of metal, and are alternately arranged between both sides of the terminal recess 60 in the housing 6.

Figure 4:
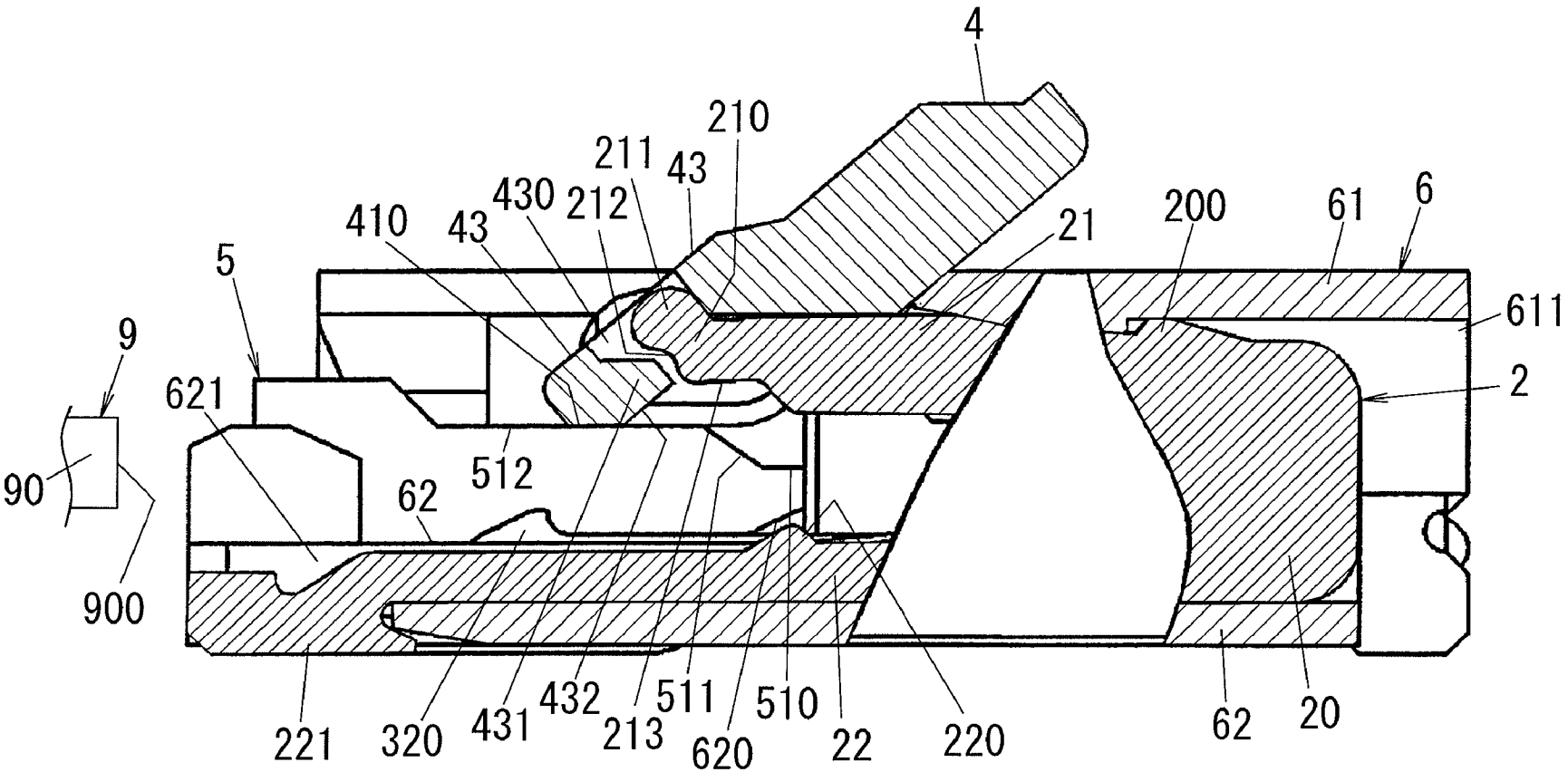
FIG. 4 is a partial exploded view of the connector of FIG. 3.

As shown in FIGS. 3 and 4, each first contact 2 is in the shape of "U", and has a base 20, an upper beam 21 and a lower beam 22. In each first contact 2, the base 20 has a retention barb 200 engaged with the inner face of the upper part (top wall) of the housing 6, and is fit into the housing 6. The upper beam 21 has a first pivotally-supporting part 210, and the base side of the upper beam 21 is thicker than that of each second contact 3, and thereby the upper beam 21 is hardly deformed in the vertical direction. The first pivotally-supporting part 210 has a boss 211 formed at the tip, and the boss 211 has an engaging surface 212 formed at the bottom of the boss 211. The lower beam 22 has a first contact point 220 formed at the intermediate point of the beam 22, and a stopper (e.g., hook) 221 for regulating insertion length of the first contact 2 into the housing 6. The first contact point 220 is located rearward by specified distance from the first pivotally-supporting part 210. When the flat terminal 90 is inserted into the terminal recess 60 closed with the lever 4, the first contact point 220 is connected with an exposed conductive pattern (not shown) in the flat terminal 90. The stopper 221 is fixed to the front edge of the terminal recess 60 in the housing 6 so that the bottom of the stopper 221 slightly sticks out from the lower part (bottom wall) of the housing 6. Thereby, the stopper 221 is employed as a lead for surface-mount.

Figure 5:
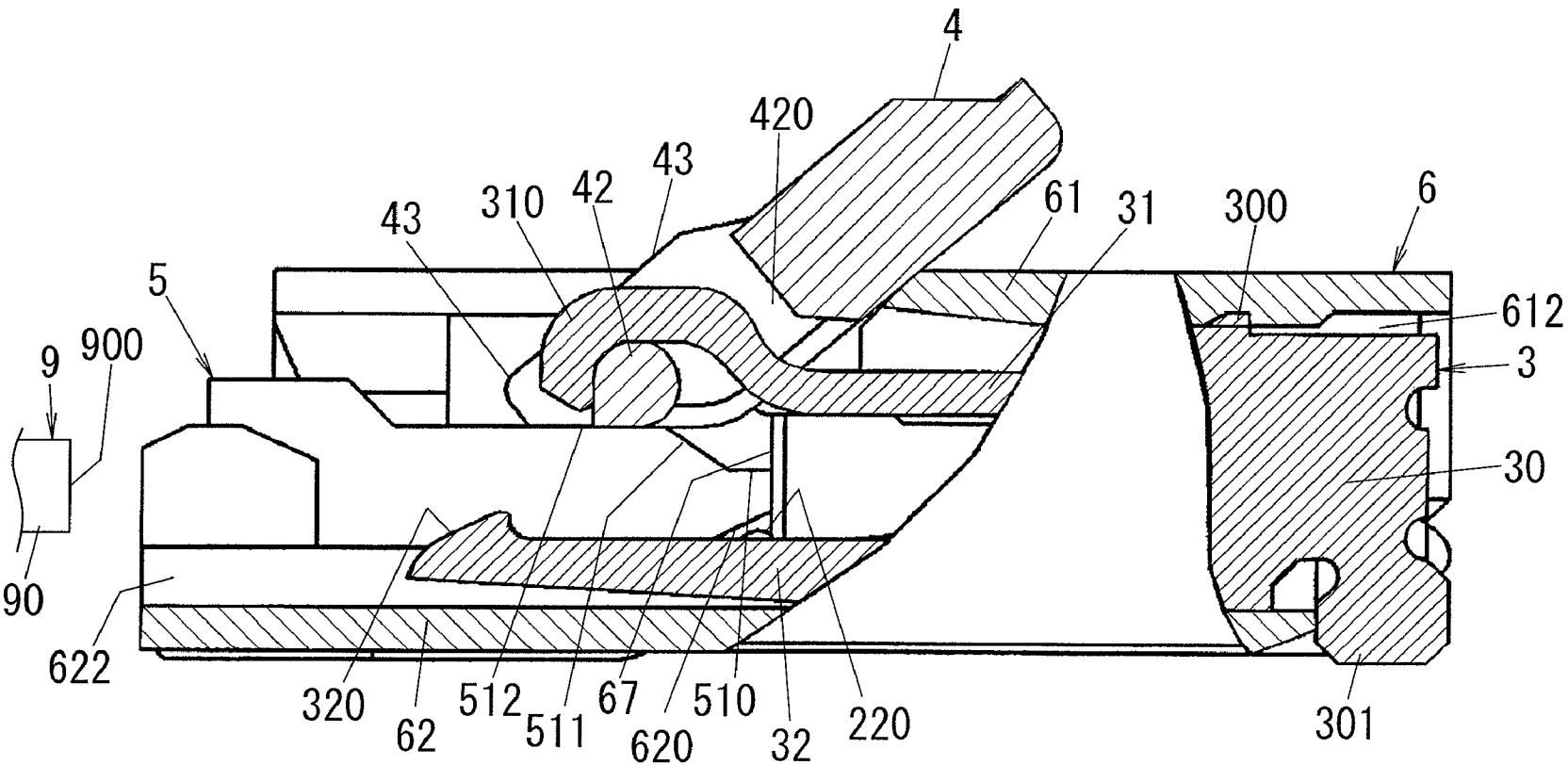
FIG. 5 is a partial exploded view of the connector of FIG. 3.

As shown in FIGS. 3 and 5, each second contact 3 is also in the shape of "U", and has a base 30, and upper and lower beams 31 and 32 which are elastically deformable. In each second contact 3, the base 30 has a retention barb 300 engaged with the inner face of the upper part of the housing 6, and a stopper 301 for regulating insertion length of the second contact 3 into the housing 6, and is fit into the housing 6. The stopper 301 is in contact with the rear edge of the lower part of the housing 6 so that the bottom of the stopper 301 slightly sticks out from the bottom of the housing 6. Thereby, the stopper 301 is employed as a lead for surface-mount. The upper beam 31 has a second pivotally-supporting part (e.g., hook) 310 formed at the tip. The lower beam 32 has a second contact point 320 formed at the tip. The second contact point 320 is located forward by specified distance from the second pivotally-supporting part 310. When the flat terminal 90 is inserted into the terminal recess 60 closed with the lever 4, the lower beam 32 is elastically deformed downward, and accordingly the second contact point 320 is elastically connected with a corresponding exposed conductive pattern in the flat terminal 90.

Figure 6:
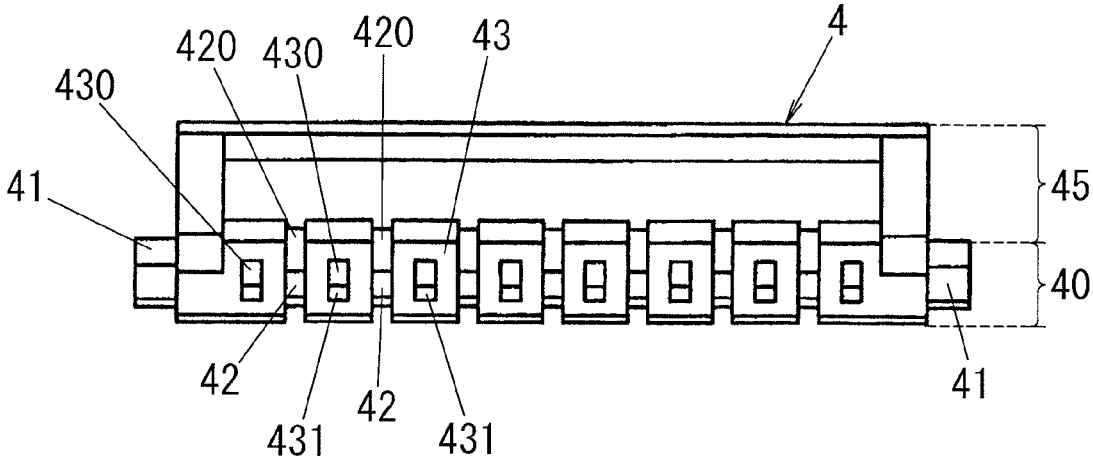
FIG. 6 is a bottom view of the connector of FIG. 3.

As shown in FIGS. 3 and 6, the lever 4 integrally has a base 40 and a handle 45. The base 40 includes pivots 41 and 41 which stick out in the axis direction of the base 40 from both sides of the lever 4, respectively, and at least one first cam 42 and at least one presser 43 which are arranged between the pivots 41 and 41. In the example of FIGS. 3 and 6, seven first cams 42 and eight pressers 43 are alternately arranged between the pivots 41 and 41.

The lever 4 is provided with the first cams 42 by forming the insertion holes (first through holes) 420 into which the second pivotally-supporting parts 310 are respectively inserted. That is, the first cams 42 of the lever 4 are respectively formed between the base end of the lever 4 and the insertion holes 420. As shown in FIG. 5, each first cam 42 is located between the upper and lower beams 31 and 32 in a corresponding second contact 3 of the second contacts 3, and engaged with the second pivotally-supporting part 310 of the corresponding second contact 3. In the example of FIG. 5, the first cam 42 is hung on the second pivotally-supporting part (hook) 310. The lever 4 is pivotally supported by the housing 6 through the pivots 41 and 41, the inner side panels 5 and 5 (two bearings), the second pivotally-supporting parts 310, and the first cams 42.

As shown in FIGS. 4 and 6, each presser 43 has an insertion hole (through hole) 430 into which the first pivotally-supporting part 210 of the upper beam 21 in a corresponding first contact 2 of the first contacts 2 can be inserted, and a second cam 431 formed at the upper rear of the insertion hole 430. Each presser 43 is also formed so that it is thicker than the other parts of the lever 4. The second cams 431 of the lever 4 are formed between the base end of the lever 4 and the insertion holes 430 and located between the upper and lower beams 21 and 22 of the first contacts 2, respectively. The first and second cams of the lever 4 are arranged in the axis direction of the base 40. When the lever 4 is opened, the bosses 211 of the first contacts 2 are respectively inserted into the insertion holes 430 of the lever 4, and the second cams 431 of the lever 4 are respectively engaged with the engaging surfaces 212 of the first contacts 2. Thereby, the first pivotally-supporting parts 210 of the first contacts 2 hold the lever 4 at an upper position for opening the terminal recess 60 from the pressers 43 of the lever 4. In this instance, the inclined surface 410 formed at the upper part of the base end of the lever 4 is paralleled with the bottom of the terminal recess 60, and the terminal recess 60 is opened. When the lever 4 is closed, the second cams 431 of the lever 4 are respectively engaged with the first pivotally-supporting parts 210 of the first contacts 2 so that the pressing surfaces of the pressers 43 of the lever 4 are sunk between the inner side panels 5 and 5. Specifically, the upper surfaces 432 of the second cams 431 in the lever 4 are in contact with the lower surfaces 213 of the first pivotally-supporting parts 210 in the first contacts 2, respectively, and the first pivotally-supporting parts 210 hold the lever 6. Thereby, the flat terminal 90 in the terminal recess 60 are pressed on the bottom of the terminal recess 90 with the pressers 43 of the lever 4, and the contact points of the first and second contacts are respectively connected with the exposed conductive patterns in the flat terminal 90. In this instance, each second contact point 320 is elastically connected with a corresponding exposed conductive pattern, while each first contact point 220 is connected with a corresponding exposed conductive pattern more firmly than each second contact point 320.

Figure 7:
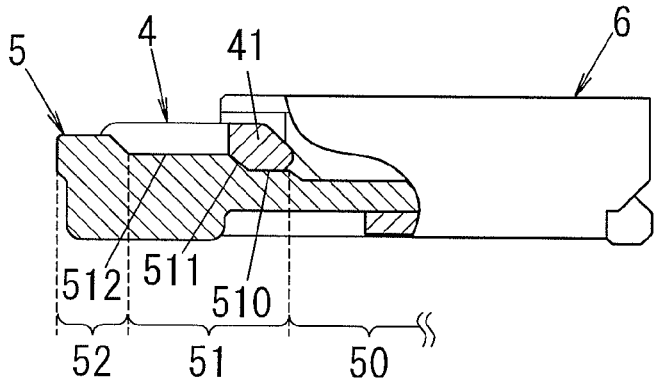
FIG. 7 is a partial exploded view of the connector of FIG. 3.

As shown in FIGS. 3 and 7, each inner side panel 5 is a reinforcing metal fitting, and integrally has: an inserted section 50 which is inserted into the housing 6; a bearing section 51 for supporting a corresponding pivot 41; and a projected end 52.

In each inner side panel 5, the top end face of the bearing section 51 includes a temporary bearing plane 510, a guide slope 511 and a bearing plane (bearing) 512. The temporary bearing plane 510 is provided for temporarily supporting a corresponding pivot 41 of the pivots 41 and 41 in the process of attaching the lever 4 to the housing 6. The guide slope 511 is provided for guiding the corresponding pivot 41 toward the bearing plane 512 by the contact of the base end of the lever 4 with the housing 6 in the process of attaching the lever 4 to the housing 6. The guide slope 511 is higher at the front end of the guide slope 511 than the rear end of the guide slope 511, and the rear end of the guide slope 511 is combined with the temporary bearing plane 510. The bearing plane 512 is provided for supporting the corresponding pivot 41 when the lever 4 is attached to the housing 6. The bearing plane 512 is combined with the front end of the guide slope 511, and the height of the bearing plane 512 is higher than that of the temporary bearing plane 510.

Figure 8:
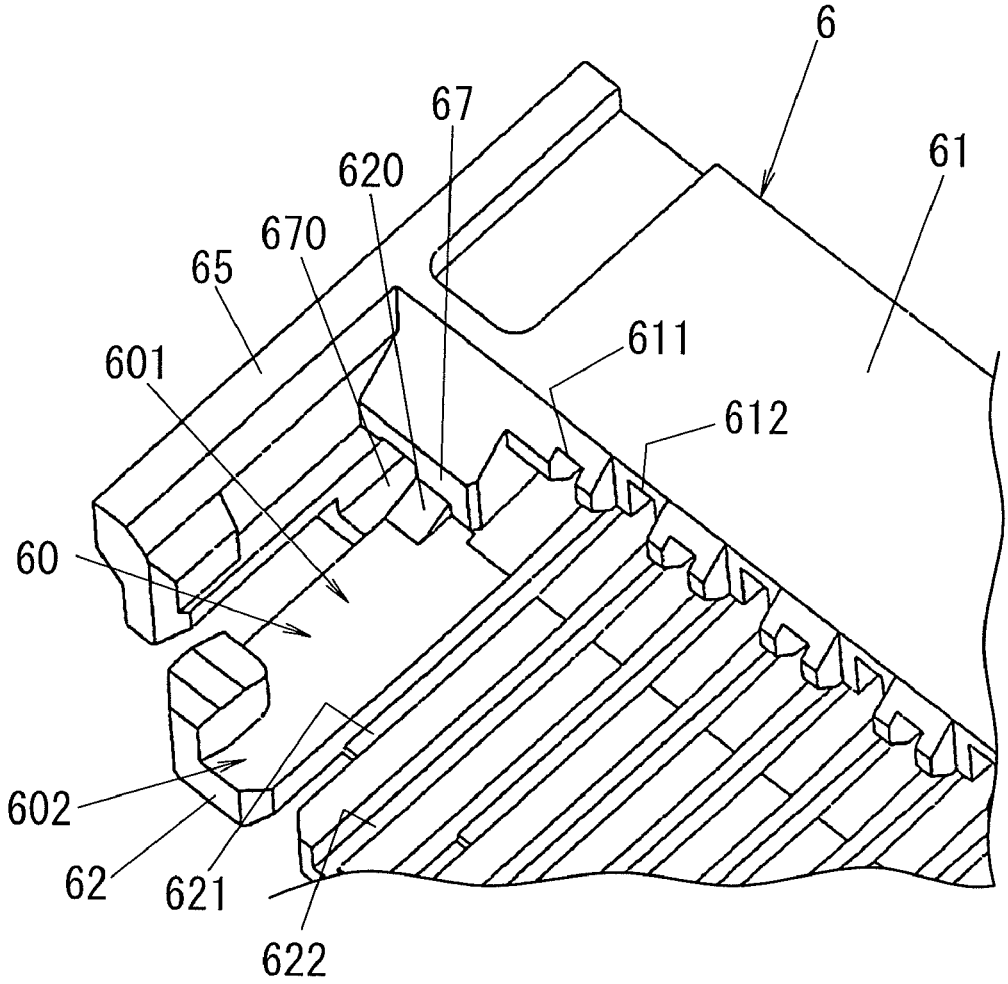
FIG. 8 is a perspective view of the essential parts in the connector of FIG. 3.

As shown in FIGS. 3 and 8, the housing 6 has a top wall (upper rear wall) 61, a bottom wall 62, a left side wall 65 and a right side wall 66, and thereby the terminal recess 60 is formed.

As shown in FIGS. 4, 5 and 8, the bottom wall 62 has grooves (long narrow furrows) for alternately arranging the lower beams of the first and second contacts, which are formed on the bottom of the terminal recess 60 in the housing 6. The grooves are deeper than each thickness of the lower beams, and lower than each contact point of the first and second contacts. Specifically, the bottom wall 62 includes grooves 621 and grooves 622. The grooves 621 are formed so that the first contacts 2 can be inserted from the front side of the housing 6, respectively. The grooves 622 are formed so that the second contacts 3 can be inserted from the rear side of the housing 6, respectively. On the other hands, the top wall 61 has grooves 611 corresponding to the grooves 621, respectively and grooves 612 corresponding to the grooves 622, respectively. The stoppers 221 of the first contacts 2 are respectively fixed to the front edge of the terminal recess 60 in the housing 6, namely the recessed front edges of the bottoms of the grooves 621.

The terminal recess 60 has a top opening 601 and a slit opening 602 constituting one opening. The top opening 601 can be opened and closed with the lever 4. The slit opening 602 is formed at the front side of the housing 6 and has a shape corresponding to the end face 900 of the flat terminal 90.

The housing 6 is also provided with two bearings that are located at both sides of the terminal recess 60 (i.e., between the left and right side walls 65 and 66), respectively and support the pivots 41 and 41 so that the terminal recess 60 can be opened and closed with the lever 4. In the embodiment, the bearings are the aforementioned bearing planes 512 and 512 that are provided by locating the inner side panels 5 and 5 inside the left and right side walls 65 and 66, respectively. Because of this, the housing 6 includes inner walls 67 and 67 that are formed inside the left and right side walls 65 and 66 and have holes 670 and 670, respectively, and the inserted sections 50 and 50 of the inner side panels 5 and 5 are inserted into the holes 670 and 670, respectively.

Figure 9:
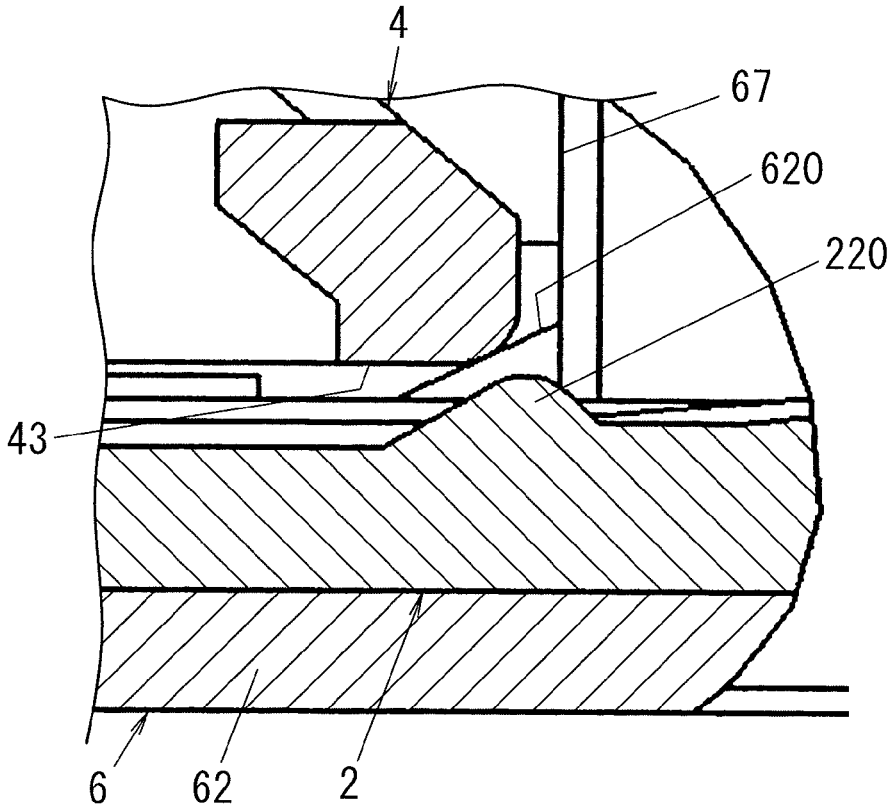
FIG. 9 is a sectional view of the essential parts in the connector of FIG. 3.
Figure 10:
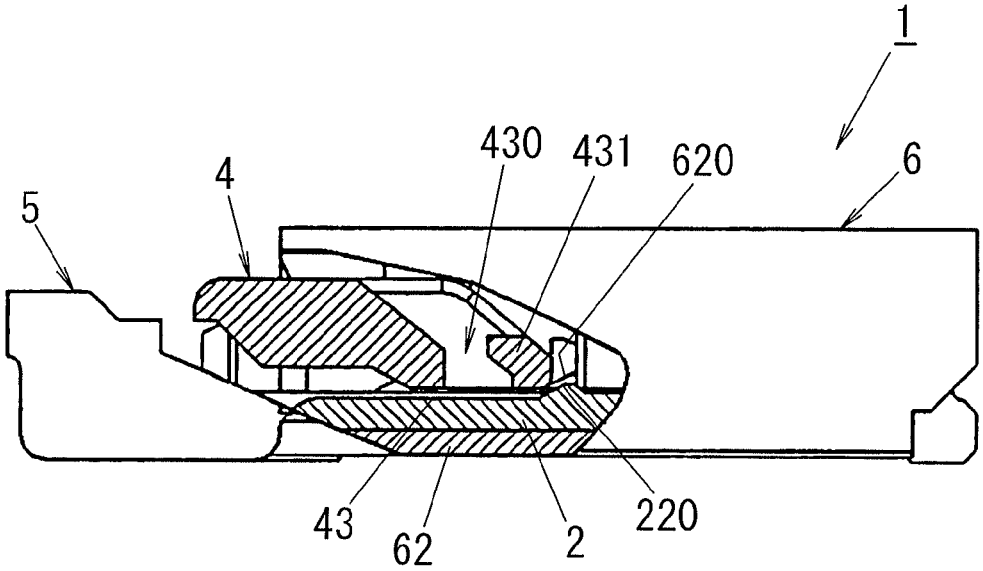
FIG. 10 is a partial exploded view of the connector of FIG. 3.

As shown in FIGS. 8-10, the housing 6 also has guide ribs 620 and 620 for separating the base end of the lever 4 from the first contact points 220 and 220 in the process of attaching the lever 4 to the housing 6. The first contact points 220 and 220 are located between the guide ribs 620 and 620. The guide ribs 620 and 620 are formed on the bottom of the terminal recess 60 in the housing 6, namely the bottom wall 62, and stick out more than each first contact point 220 from the bottom of the terminal recess 60. Each guide rib 620 has a slope which is higher at its own rear end than its own front end. The rear ends of the guide rib 620 and 620 are respectively combined with the inner walls 67 and 67.

In the connector 1, the first and second pivotally-supporting parts are alternately arranged in line in the length (width) direction of the housing 6. The first contact points 220 are located rearward by specified distance from the first pivotally-supporting parts 210, respectively, while the second contact points 320 are located forward by specified distance from the second pivotally-supporting parts 310, respectively. In short, the first contact points 220 are arranged in line at the intermediate point of the housing 6, and the second contact points 320 are arranged in line near the front side of the housing 6. When the flat terminal 90 is inserted into the terminal recess 60 closed with the lever 4, the first and second contact points are in contact with exposed conductive patterns arranged in width direction in the flat terminal 90, respectively.

Also, in the connector 1, the flat terminal 90 is inserted in the terminal recess 60 of the housing 6 and the lever 4 is closed, and then the pressers 43 of the lever 4 press the flat terminal 90. Thereby, the first and second contact points respectively come into contact with the exposed conductive patterns of the flat terminal 90 and are electrically connected with the patterns. In this instance, the lower beams 32 are pressed downward with the flat terminal 90 and then elastically deformed, and accordingly each second contact point 320 can be elastically connected with a corresponding exposed conductive pattern at moderate pressure.

Figure 11:
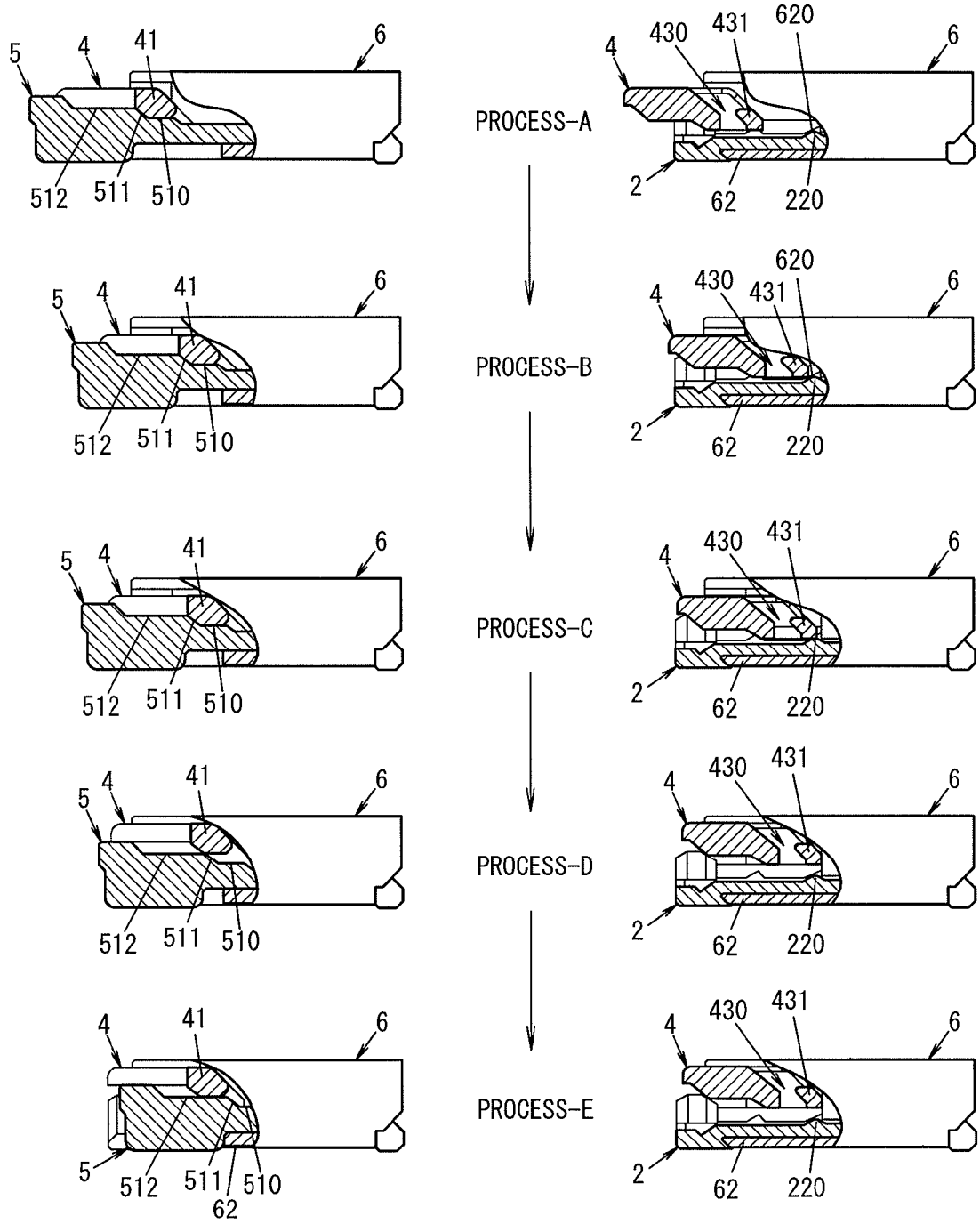
FIG. 11 is an explanatory diagram of assembling process of the connector of FIG. 3.

The assembling process of the connector 1 is now explained with reference to FIG. 11. In FIG. 11, each figure in left column is a partial exploded view of the connector 1 along the length direction of an inner side panel 5, and each figure in right column is a partial exploded view of the connector 1 along the length direction of a groove 621.

As shown in "PROCESS-A" of FIG. 11, the pivots 41 and 41 of the lever 4 pulled down are respectively put on the temporary bearing planes 510 and 510 of the inner side panels 5 and 5. The inserted sections 50 and 50 of the inner side panels 5 and 5 are then inserted into the holes 670 and 670 of the housing 6, respectively.

Thereby, the base end of the lever 4 (i.e., each presser 43 (second cam 431)) comes closer to each first contact point 220 as shown in "PROCESS-B" of FIG. 11, and then the base end of the lever 4 comes at the guide ribs 620 and 620 as shown in "PROCESS-C" of FIG. 11. Subsequently, the inserted sections 50 and 50 are further inserted, and thereby the lever 4 moves upward along the slopes of the guide ribs 620 and 620 and the base end of the lever 4 then come into contact with the inner walls 67 and 67 of the housing 6. Accordingly, the pivots 41 and 41 of the lever 4 are guided to the bearing planes 512 and 512 through the guide slopes 511 and 511, respectively, and thereby the lever 4 moves upward and then the pivots 41 and 41 come at the rear ends of the bearing planes 512 and 512, respectively, as shown in "PROCESS-D" of FIG. 11. Each first cam 42 also moves upward and is then inserted into the second pivotally-supporting part 310 of a corresponding second contact 3, namely the hook.

As shown in "PROCESS-E" of FIG. 11, the lower bottom ends in the bearing sections 51 and 51 of the inner side panels 5 and 5 come into contact with the recessed bottom wall 62 immediately beneath the holes 670 and 670 of the inner walls 67 and 67. Thereby, the assembling process of the connector 1 is completed and the pivots 41 and 41 are respectively put on bearing planes 512 and 512. Each first cam 42 is also engaged with the second pivotally-supporting part 310 of a corresponding second contact 3.

Thus, in the process of attaching the lever 4 to the housing 6, the base end of the lever 4 is separated from each first contact point 220 and the base end is not in contact with each first contact point 220, and accordingly it is possible to prevent the lever 4 from being shaved with each first contact point 220. Consequently, contact failure between each exposed conductive pattern of the flat terminal 90 and each first contact 2 can be prevented, and connection reliability of the connector 1 can be improved.

Although the present invention has been described with reference to certain preferred embodiments, numerous modifications and variations can be made by those skilled in the art without departing from the true spirit and scope of this invention.

What is claimed is:

1. A connector for a flat terminal comprising an exposed conductive pattern, comprising:

a lever having pivots which stick out from both sides of the lever, respectively;

a housing which is formed with a terminal recess having a shape corresponding to the flat terminal, the housing being also provided with bearings which are located at both sides of the terminal recess and support the pivots so that the lever can open and close the terminal recess, respectively; and a contact which is located in the terminal recess and has a contact point connected with the exposed conductive pattern when the flat terminal is inserted into the terminal recess closed with the lever, wherein the housing comprises guide ribs for separating the base end of the lever from the contact point in the process of attaching the lever to the housing, the contact point being located between the guide ribs, the guide ribs being formed on the bottom of the terminal recess in the housing, the guide ribs sticking out more than the contact point from the bottom of the terminal recess, and wherein said contact point is fixed in the terminal recess so that it is inhibited from moving in the projecting direction of said guide ribs.

2. The connector of claim 1, wherein the terminal recess has a top opening and a slit opening constituting one opening, the top opening being able to be opened and closed with the lever, the slit opening being formed at the front side of the housing, the slit opening having a shape corresponding to the end face of the flat terminal, wherein each of the guide ribs has a slope which is higher at its own rear end than its own front end, wherein the housing has inner walls combined with the rear ends of the guide ribs, respectively, and is also provided with inner side panels made of metal, the inner side panels being respectively located at both sides of the terminal recess, each top end face of the inner side panels including: a temporary bearing plane for temporarily supporting a corresponding pivot of said pivots in the process of attaching the lever to the housing; a guide slope for guiding the corresponding pivot toward a corresponding bearing of said bearings by the contact of the base end of the lever with the guide ribs and the inner walls in the process of attaching the lever to the housing; and a bearing plane for supporting the corresponding pivot when the lever is attached to the housing, said guide slope being higher at the front end of the guide slope than the rear end of the guide slope, the rear end of the guide slope being combined with said temporary bearing plane, said bearing plane being said corresponding bearing and combined with the front end of said guide slope, the height of said bearing plane being higher than that of said temporary bearing plane.

3. The connector of claim 2, wherein the lever integrally comprises a base and a handle, the base including the pivots, and at least one first cam and at least one presser which are arranged between the pivots.

4. The connector of claim 3, wherein the contact comprises at least one first contact having an upper beam and a lower beam, the lower beam having a first contact point which is said contact point, and a stopper fixed to the front edge of the terminal recess in the housing, wherein the presser has an insertion hole into which the tip of the upper beam can be inserted, and a second cam formed at the upper rear of the insertion hole, the second cam being located between the upper and lower beams of the first contact, the second cam being in contact with the tip of the upper beam so that the pressing surface of the presser is sunk between the inner side panels when the terminal recess is closed with the lever.

5. The connector of claim 4, comprising at least one second contact which is located in the terminal recess and has an upper beam and a lower beam, wherein the flat terminal comprises exposed conductive patterns, wherein: the upper beam of the second contact has a pivotally-supporting part engaged with the first cam between the upper and lower beams of the second contact; and the lower beam of the second contact has a second contact point which is located ahead of the first contact point and can be elastically connected with an exposed conductive pattern of the flat terminal.

* * * * *